US007469743B2

(12) United States Patent
Richards

(10) Patent No.: US 7,469,743 B2
(45) Date of Patent: Dec. 30, 2008

(54) INFLOW CONTROL DEVICES FOR SAND CONTROL SCREENS

(75) Inventor: William M. Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/668,024

(22) Filed: Jan. 29, 2007

(65) Prior Publication Data

US 2007/0246210 A1 Oct. 25, 2007

Related U.S. Application Data

(63) Continuation-in-part of application No. 11/409,734, filed on Apr. 24, 2006.

(51) Int. Cl.
*E21B 43/08* (2006.01)

(52) U.S. Cl. ..... 166/242.1; 166/227

(58) Field of Classification Search ..... 166/205, 166/227, 230, 231, 236, 242.1
See application file for complete search history.

(56) References Cited

U.S. PATENT DOCUMENTS

| | | | |
|---|---|---|---|
| 2,762,437 | A | 9/1956 | Egan et al. |
| 2,849,070 | A | 8/1958 | Maly |
| 2,945,541 | A | 7/1960 | Maly |
| 2,981,332 | A | 4/1961 | Miller |
| 2,981,333 | A | 4/1961 | Miller |
| 3,477,506 | A | 11/1969 | Malone |
| 4,287,952 | A | 9/1981 | Erbstoesser |
| 4,491,186 | A | 1/1985 | Alder |
| 4,974,674 | A | 12/1990 | Wells |
| 4,998,585 | A | 3/1991 | Newcomer |
| 5,333,684 | A | 8/1994 | Walter |
| 5,337,821 | A | 8/1994 | Peterson |
| 5,435,393 | A | 7/1995 | Brekke |
| 5,673,751 | A | 10/1997 | Head |
| 5,730,223 | A | 3/1998 | Restarick |
| 5,803,179 | A | 9/1998 | Echols |
| 5,896,928 | A | 4/1999 | Coon |

(Continued)

FOREIGN PATENT DOCUMENTS

| | | |
|---|---|---|
| GB | 2314866 | 1/1998 |

(Continued)

OTHER PUBLICATIONS

SPE 102208, "Means for Passive-Inflow Control Upon Gas Breakthrough," dated Sep. 24-27, 2006.

(Continued)

*Primary Examiner*—Jennifer H Gay
*Assistant Examiner*—Daniel P Stephenson
(74) *Attorney, Agent, or Firm*—Marlin R. Smith

(57) ABSTRACT

Inflow control devices for sand control screens. A well screen includes a filter portion and at least one flow restrictor configured so that fluid which flows through the filter portion also flows through the flow restrictor. The flow restrictor includes at least one tube which forces the fluid to change momentum within the tube. An inflow control device for restricting flow into a passage of a tubular string in a wellbore includes at least one flow restrictor configured so that fluid flows between the passage and the flow restrictor. The flow restrictor includes at least one tube which forces the fluid to change momentum within the tube.

14 Claims, 14 Drawing Sheets

U.S. PATENT DOCUMENTS

| | | | | |
|---|---|---|---|---|
| 6,112,815 | A | 9/2000 | Boe | |
| 6,112,817 | A | 9/2000 | Voll | |
| 6,253,861 | B1 | 7/2001 | Carmichael | |
| 6,305,470 | B1 | 10/2001 | Woie | |
| 6,371,210 | B1 | 4/2002 | Bode | |
| 6,431,282 | B1 | 8/2002 | Bosma | |
| 6,478,091 | B1 | 11/2002 | Gano | |
| 6,505,682 | B2 | 1/2003 | Brockman | |
| 6,516,888 | B1 | 2/2003 | Gunnarson | |
| 6,622,794 | B2 | 9/2003 | Zisk | |
| 6,679,324 | B2 | 1/2004 | Den Boer | |
| 6,695,067 | B2 | 2/2004 | Johnson | |
| 6,719,051 | B2 | 4/2004 | Hailey | |
| 6,786,285 | B2 | 9/2004 | Johnson | |
| 6,817,416 | B2 | 11/2004 | Wilson | |
| 6,834,725 | B2 | 12/2004 | Whanger | |
| 6,851,560 | B2 | 2/2005 | Reig | |
| 6,857,475 | B2 | 2/2005 | Johnson | |
| 6,857,476 | B2 | 2/2005 | Richards | |
| 6,886,634 | B2 | 5/2005 | Richards | |
| 6,907,937 | B2 | 6/2005 | Whanger | |
| 7,059,401 | B2 | 6/2006 | Bode | |
| 7,063,162 | B2 | 6/2006 | Daling | |
| 7,096,945 | B2 | 8/2006 | Richards et al. | |
| 7,100,686 | B2 | 9/2006 | Wittrisch | |
| 7,108,083 | B2 | 9/2006 | Simonds et al. | |
| 7,185,706 | B2 | 3/2007 | Freyer | |
| 7,426,962 | B2 | 9/2008 | Moen | |
| 2002/0056553 | A1 | 5/2002 | Duhon | |
| 2004/0020662 | A1 | 2/2004 | Freyer | |
| 2004/0035590 | A1 | 2/2004 | Richard | |
| 2004/0060706 | A1 | 4/2004 | Stephenson | |
| 2004/0108107 | A1* | 6/2004 | Wittrisch | 166/227 |
| 2004/0112609 | A1 | 6/2004 | Whanger | |
| 2004/0144544 | A1 | 7/2004 | Freyer | |
| 2005/0016732 | A1 | 1/2005 | Brannon | |
| 2005/0110217 | A1 | 5/2005 | Wood | |
| 2005/0173130 | A1 | 8/2005 | Richard | |
| 2006/0076150 | A1 | 4/2006 | Coronado | |
| 2006/0113089 | A1 | 6/2006 | Henrikson | |
| 2006/0118296 | A1 | 6/2006 | Dybevik | |
| 2006/0185849 | A1 | 8/2006 | Edwards | |
| 2007/0246407 | A1 | 10/2007 | Richards et al. | |

FOREIGN PATENT DOCUMENTS

| | | |
|---|---|---|
| GB | 2356879 | 6/2001 |
| GB | 2371578 | 7/2002 |
| GB | 2341405 | 3/2006 |
| WO | WO02075110 | 9/2002 |
| WO | 2004057715 | 7/2004 |
| WO | 2005116394 | 12/2005 |
| WO | 2006003112 | 1/2006 |
| WO | 2006003113 | 1/2006 |

OTHER PUBLICATIONS

International Search Report for PCT/NO02/00158.
U.S. Appl. No. 11/407,704, filed Apr. 20, 2006.
U.S. Appl. No. 11/466,022, filed Aug. 21, 2006.
U.S. Appl. No. 11/409,734, filed Apr. 4, 2006.
U.S. Appl. No. 11/407,848, filed Apr. 20, 2006.
U.S. Appl. No. 11/502,074, filed Aug. 10, 2006.
U.S. Appl. No. 11/702,312, filed Feb. 5, 2007.
Weatherford, "Application Answers," product brochure, dated 2005.
SPE 25891, "Perforation Friction Pressure of Fracturing Fluid Slurries," Halliburton Services, dated 1993.
Office Action for U.S. Appl. No. 10/477,440, dated Jun. 14, 2006.
Examination report for GB 0707831.4 dated Jul. 16, 2007.
International Search Report and Written Opinion issued for International Application No. PCT/US07/75743 dated Feb. 11, 2008 (8 pages).
Office Action issued for USSN 11/466,022 dated Feb. 8, 2008 (30 pages).
Office Action dated Aug. 26, 2008, for U.S. Appl. No. 11/466,022 (8 pages).

* cited by examiner

INFLOW CONTROL DEVICES FOR SAND CONTROL SCREENS

CROSS-REFERENCE TO RELATED APPLICATION

The present application is a continuation-in-part of U.S. application Ser. No. 11/409,734, filed Apr. 24, 2006, the entire disclosure of which is incorporated herein by this reference.

BACKGROUND

The present invention relates generally to equipment utilized and operations performed in conjunction with subterranean wells and, in an embodiment described herein, more particularly provides inflow control devices for sand control screens.

Certain well installations benefit from having a flow restriction device in a well screen. For example, such flow restriction devices have been useful in preventing water coning, balancing production from long horizontal intervals, etc. These flow restriction devices are sometimes referred to as "inflow control devices."

Unfortunately, typical inflow control devices rely on very small passages in orifices or nozzles to restrict flow, and typical inflow control devices cannot be conveniently adjusted at a jobsite, or are at least difficult to adjust. Small orifice passages are easily plugged, and the large pressure drop across an orifice tends to erode the passage relatively quickly.

Therefore, it may be seen that improvements are needed in the art of well screens having inflow control devices. It is among the objects of the present invention to provide such improvements.

SUMMARY

In carrying out the principles of the present invention, a well screen and associated inflow control device are provided which solve at least one problem in the art. One example is described below in which the inflow control device includes a flow restrictor which is conveniently accessible just prior to installing the screen. Another example is described below in which multiple flow restrictors are configured and positioned to provide enhanced flow restriction.

In one aspect of the invention, an inflow control device is provided for restricting flow into a passage of a tubular string in a wellbore. The inflow control device includes at least one flow restrictor configured so that fluid flows between the passage and the flow restrictor. The flow restrictor includes at least one tube which forces the fluid to change momentum within the tube.

In another aspect of the invention, a well screen is provided. The well screen includes a filter portion and at least one flow restrictor configured so that fluid which flows through the filter portion also flows through the flow restrictor. The flow restrictor includes at least one tube which forces the fluid to change momentum within the tube.

The tube may be formed so that it alternates direction or extends circumferentially relative to a base pipe, to thereby force the fluid to change momentum within the tube. The tube could, for example, change longitudinal direction or extend helically between its ends.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
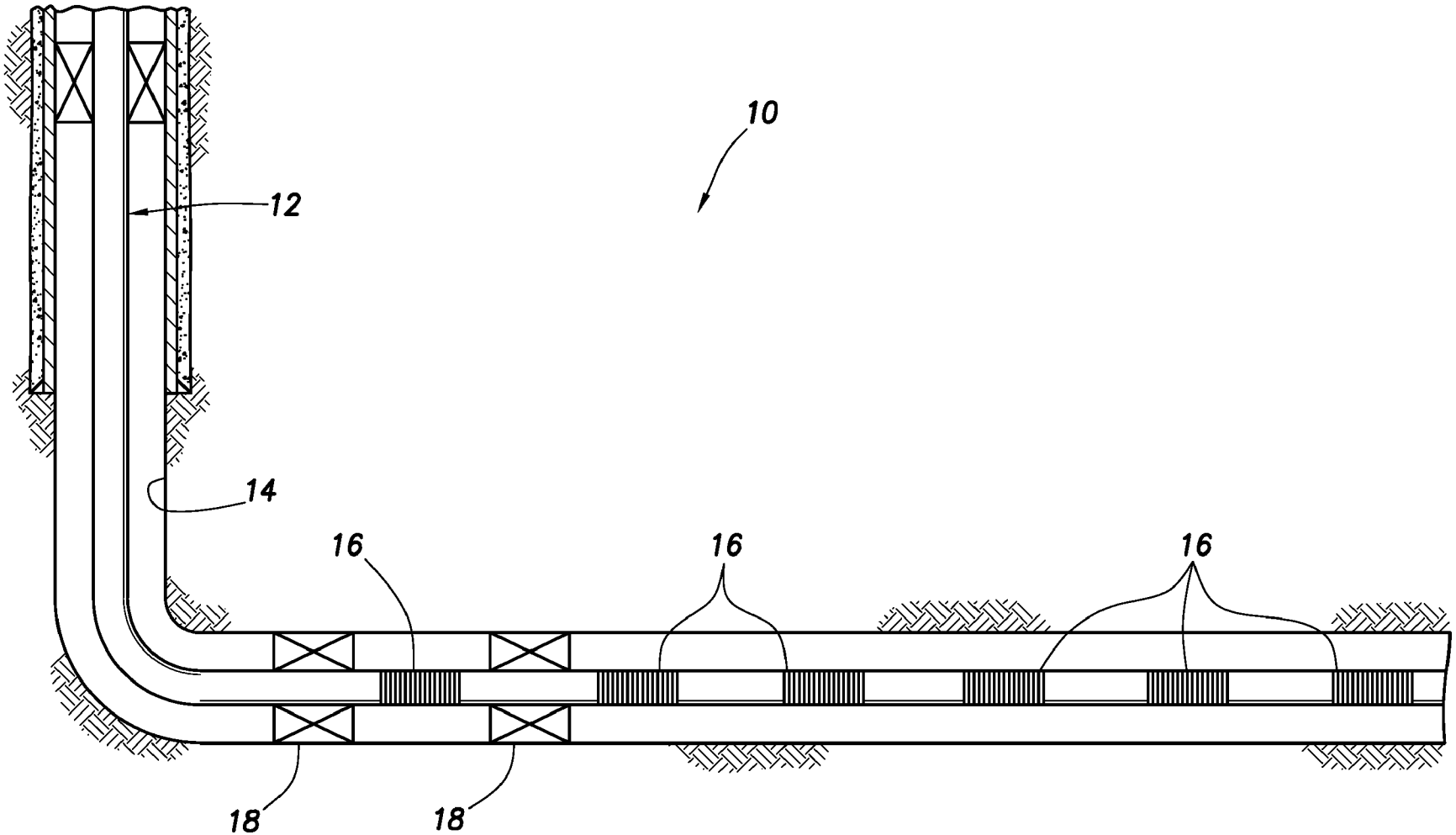
FIG. 1 is a schematic partially cross-sectional view of a well system embodying principles of the present invention.

Representatively illustrated in FIG. 1 is a well system 10 which embodies principles of the present invention. A production tubing string 12 is installed in a wellbore 14 of a well. The tubing string 12 includes multiple well screens 16 positioned in an uncased generally horizontal portion of the wellbore 14.

One or more of the well screens 16 may be positioned in an isolated portion of the wellbore 14, for example, between packers 18 set in the wellbore. In addition, or alternatively, many of the well screens 16 could be positioned in a long, continuous portion of the wellbore 14, without packers isolating the wellbore between the screens.

Gravel packs could be provided about any or all of the well screens 16, if desired. A variety of additional well equipment (such as valves, sensors, pumps, control and actuation devices, etc.) could also be provided in the well system 10.

It should be clearly understood that the well system 10 is merely representative of one well system in which the principles of the invention may be beneficially utilized. However, the invention is not limited in any manner to the details of the well system 10 described herein. For example, the screens 16 could instead be positioned in a cased and perforated portion of a wellbore, the screens could be positioned in a generally vertical portion of a wellbore, the screens could be used in an injection well, rather than in a production well, etc.

Figure 2:
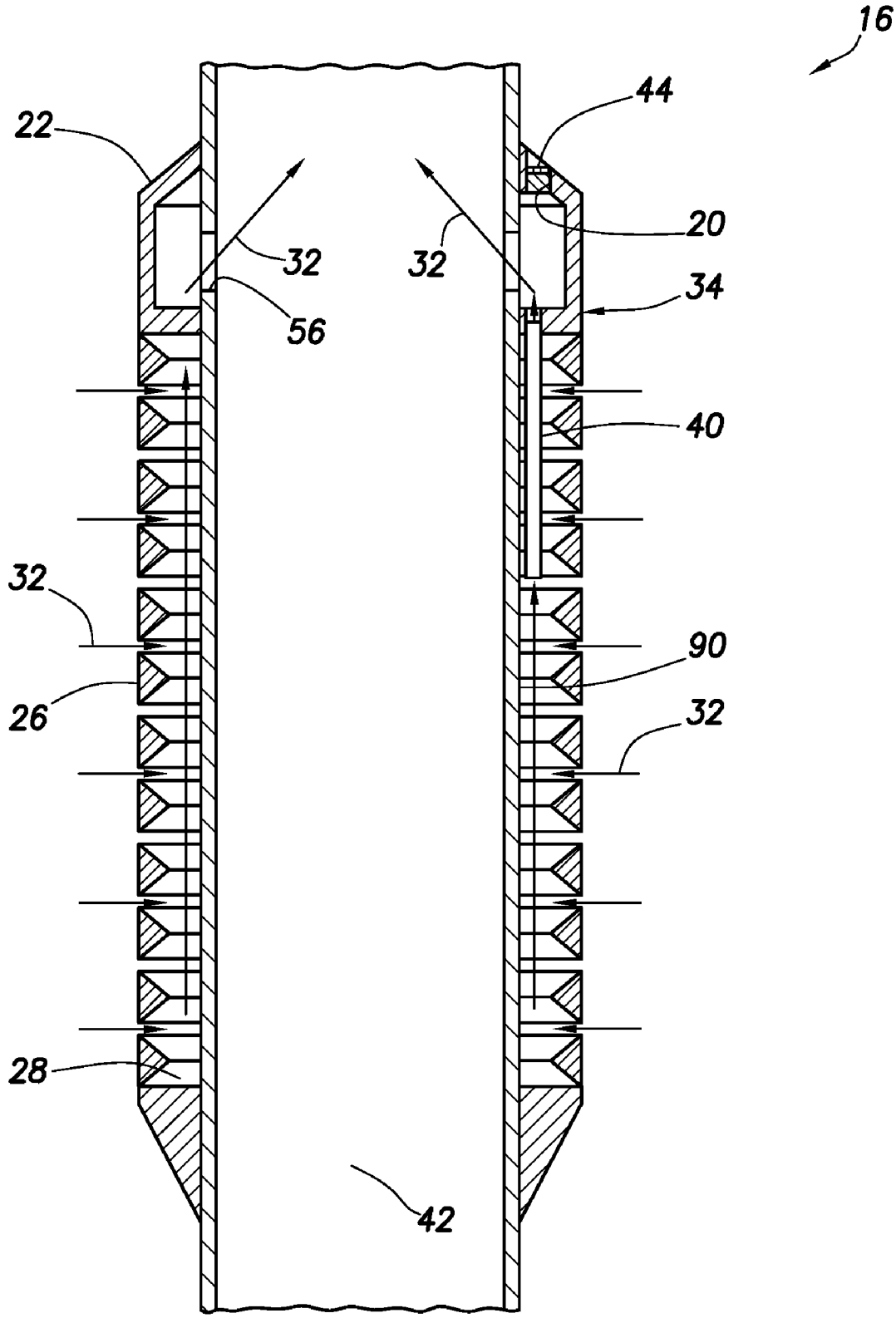
FIG. 2 is an enlarged scale cross-sectional view of a well screen which may be used in the system of FIG. 1, the well screen including an inflow control device embodying principles of the present invention.

Referring additionally now to FIG. 2, an enlarged scale schematic cross-sectional view of the screen 16 is representatively illustrated. The well screen 16 may be used in the well system 10, or it may be used in any other well system in keeping with the principles of the invention.

A fluid 32 flows inwardly through a filter portion 26 of the screen 16. The filter portion 26 is depicted in FIG. 2 as being made up of wire wraps, but other types of filter material (such as mesh, sintered material, pre-packed granular material, etc.) may be used in other embodiments.

The fluid 32 enters an annular space 28 between the filter portion 26 and a tubular base pipe 90 of the screen 14. The fluid 32 then passes through an inflow control device 34, and into a flow passage 42 extending longitudinally through the screen 16. When interconnected in the tubing string 12 in the well system 10 of FIG. 1, the flow passage 42 is a part of a flow passage extending through the tubing string.

Although the flow passage 42 is depicted in FIG. 1 and others of the drawings as extending internally through the filter portion 26, it will be appreciated that other configurations are possible in keeping with the principles of the invention. For example, the flow passage could be external to the filter portion, in an outer shroud of the screen 16, etc.

The inflow control device 34 includes one or more flow restrictors 40 (only one of which is visible in FIG. 2) to restrict inward flow through the screen 16 (i.e., between the filter portion 26 and the flow passage 42). As depicted in FIG. 2, the flow restrictor 40 is in the shape of an elongated tube. A length, inner diameter and other characteristics of the tube may be varied to thereby vary the restriction to flow of the fluid 32 through the tube.

Although the inflow control device 34 is described herein as being used to restrict flow of fluid from the filter portion 26 to the flow passage 42, it will be appreciated that other configurations are possible in keeping with the principles of the invention. For example, if the flow passage is external to the filter portion 26, then the inflow control device could restrict flow of fluid from the flow passage to the filter portion, etc.

One advantage to using a tube for the flow restrictor 40 is that a larger inner diameter may be used to produce a restriction to flow which is equivalent to that produced by an orifice or nozzle with a smaller diameter passage. The larger inner diameter will not plug as easily as the smaller diameter passage. In addition, the extended length of the tube causes any erosion to be distributed over a larger surface area. However, an orifice or nozzle could be used in place of a tube for the flow restrictor 40, if desired.

In a beneficial feature of the screen 16 as depicted in FIG. 2, the flow restrictor 40 is accessible via an opening 20 formed in an end wall 22 of the inflow control device 34. A plug 44 is shown in FIG. 2 blocking flow through the opening 20.

It will be appreciated that the opening 20 in the end wall 22 of the inflow control device 34 provides convenient access to the flow restrictor 40 at a jobsite. When the well conditions and desired production parameters are known, the appropriate flow restrictor 40 may be selected (e.g., having an appropriate inner diameter, length and other characteristics to produce a desired flow restriction or pressure drop) and installed in the inflow control device 34 through the opening 20.

To install the flow restrictor 40 in the inflow control device 34, appropriate threads, seals, etc. may be provided to secure and seal the flow restrictor. The plug 44 is then installed in the opening 20 using appropriate threads, seals, etc. Note that any manner of sealing and securing the flow restrictor 40 and plug 44 may be used in keeping with the principles of the invention.

Figure 3:
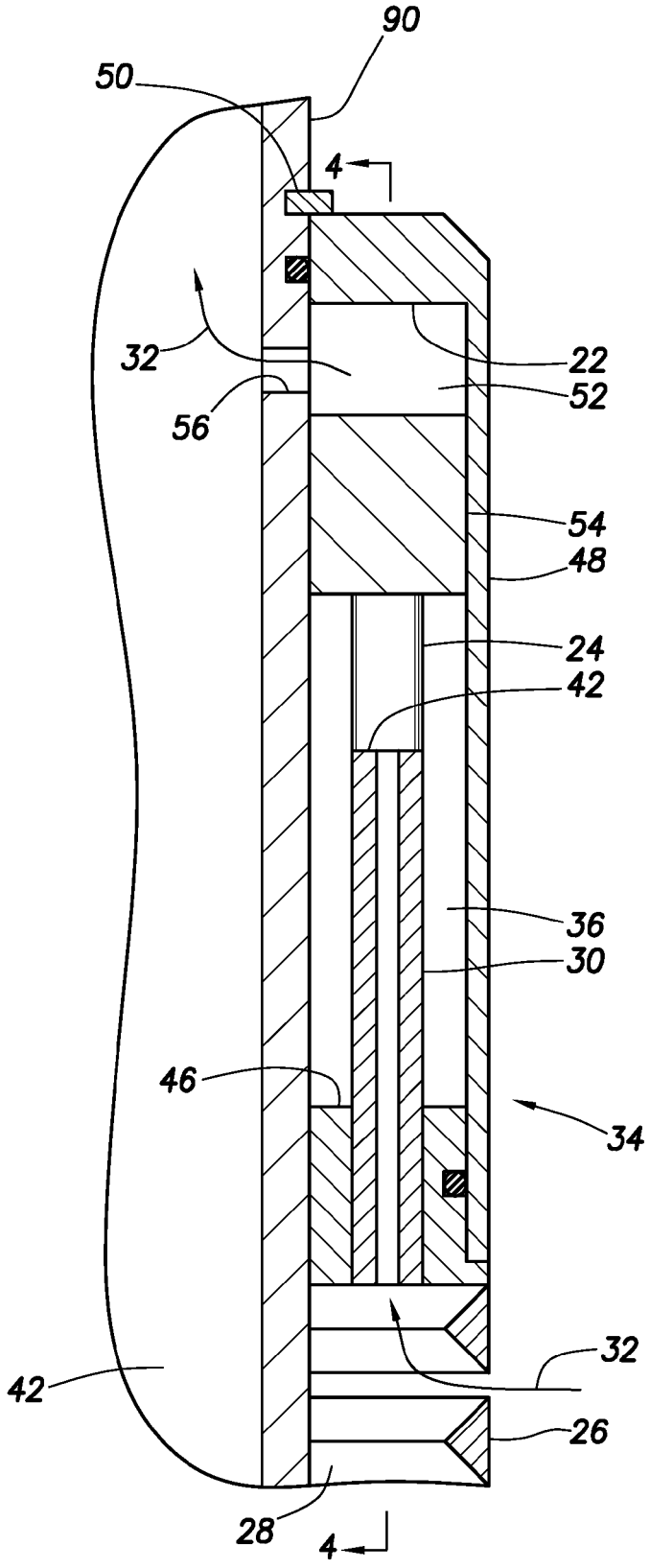
FIG. 3 is a further enlarged scale cross-sectional view of a first alternate construction of the inflow control device.

Referring additionally now to FIG. 3, an enlarged scale schematic cross-sectional view of an alternate construction of the inflow control device 34 is representatively illustrated. The inflow control device 34 as depicted in FIG. 3 may be used in the well screen 16, or it may be used in other well screens in keeping with the principles of the invention.

The inflow control device 34 includes multiple flow restrictors 24, 30 configured in series. The flow restrictors 24, 30 are in the shape of elongated tubes, similar to the flow restrictor 40 described above. However, in the embodiment of FIG. 3, the flow restrictors 24, 30 are positioned so that the fluid 32 must change direction twice in order to flow between the flow restrictors.

Figure 4:
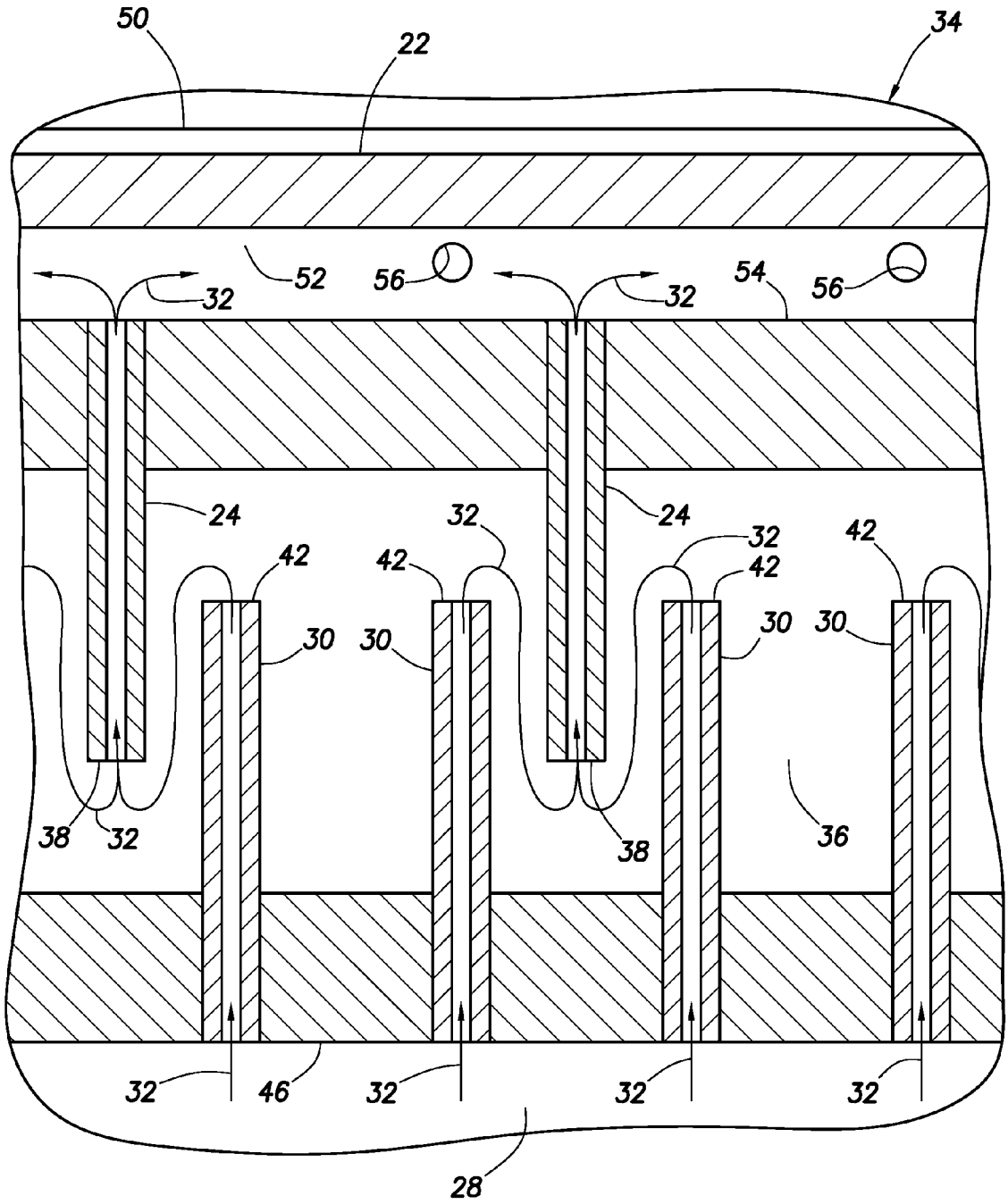
FIG. 4 is a cross-sectional view of the inflow control device, taken along line 4-4 of FIG. 3.

Another cross-sectional view of the inflow control device 34 is illustrated in FIG. 4. The cross-sectional view is of a portion of the inflow control device 34 as if it were "unrolled," i.e., FIG. 4 is a circumferential development of the cross-section.

In this view, the manner in which the flow restrictors 24, 30 are arranged in the device 34 to cause the fluid 32 to change direction may be clearly seen. The flow restrictors 24, 30 extend into a central chamber 36. Ends 38, 43 of the flow restrictors 24, 30 extend in opposite directions, and the flow restrictors overlap laterally, so that the fluid 32 is forced to reverse direction twice in flowing between the flow restrictors.

From the annular space 28, the fluid 32 flows into the flow restrictors 30 which are installed in a bulkhead 46. Any means of sealing and securing the flow restrictors 30 in the bulkhead 46 may be used. The flow restrictors 30 restrict the flow of the fluid 32, so that a pressure drop results between the annular space 28 and the chamber 36.

The pressure drop between the annular space 28 and the chamber 36 may be adjusted by varying the number of the flow restrictors 30, varying the inner diameter, length and other characteristics of the flow restrictors, replacing a certain number of the flow restrictors with plugs, replacing some or all of the flow restrictors with orifices or nozzles, not installing some or all of the flow restrictors (i.e., thereby leaving a relatively large opening in the bulkhead 46), etc. Although four of the flow restrictors 30 are depicted in FIG. 4, any appropriate number may be used in practice.

The flow restrictors 24, 30 may be conveniently accessed and installed or removed by removing an outer housing 48 of the device 34 (see FIG. 3). A snap ring or other securement 50 may be used to provide convenient removal and installation of the outer housing 48, thereby allowing the flow restrictors 24, 30 to be accessed at a jobsite. Alternatively, openings and plugs (such as the opening 20 and plug 44 described above) could be provided in the end wall 22 for access to the flow restrictors 24, 30.

After the fluid 32 flows out of the ends 43 of the flow restrictors 30, the fluid enters the chamber 36. Since the ends 38, 43 of the flow restrictors 24, 30 overlap, the fluid 32 is forced to reverse direction twice before entering the ends 38 of the flow restrictors 24. These abrupt changes in direction cause turbulence in the flow of the fluid 32 and result in a further pressure drop between the flow restrictors 24, 30. This pressure drop is uniquely achieved without the use of small passages which might become plugged or eroded over time.

As the fluid 32 flows through the flow restrictors 24, a further pressure drop results. As discussed above, the restriction to flow through the flow restrictors 24 may be altered by varying the length, inner diameter, and other characteristics of the flow restrictors.

Due to this flow restriction, a pressure drop is experienced between the chamber 36 and another chamber 52 on an opposite side of a bulkhead 54 in which the flow restrictors 24 are installed. Any method may be used to seal and secure the flow restrictors 24 in the bulkhead 54, such as threads and seals, etc.

When the fluid 32 enters the chamber, another change in direction is required for the fluid to flow toward openings 56 which provide fluid communication between the chamber 52 and the flow passage 42. After flowing through the openings 56, a further change in direction is required for the fluid 32 to flow through the passage 42. Thus, another pressure drop is experienced between the chamber 52 and the passage 42.

It will be readily appreciated by those skilled in the art that the configuration of the inflow control device 34 as shown in FIGS. 3 & 4 and described above provides a desirable and adjustable total pressure drop between the annular space 28 and the flow passage 42 without requiring very small passages in orifices (although these could be used if desired), and also provides convenient access to the flow restrictors 24, 30 at a jobsite. Although the flow restrictors 24, 30 have been described above as being in the shape of tubes, it should be understood that other types and combinations of flow restrictors may be used in keeping with the principles of the invention.

Figure 5:
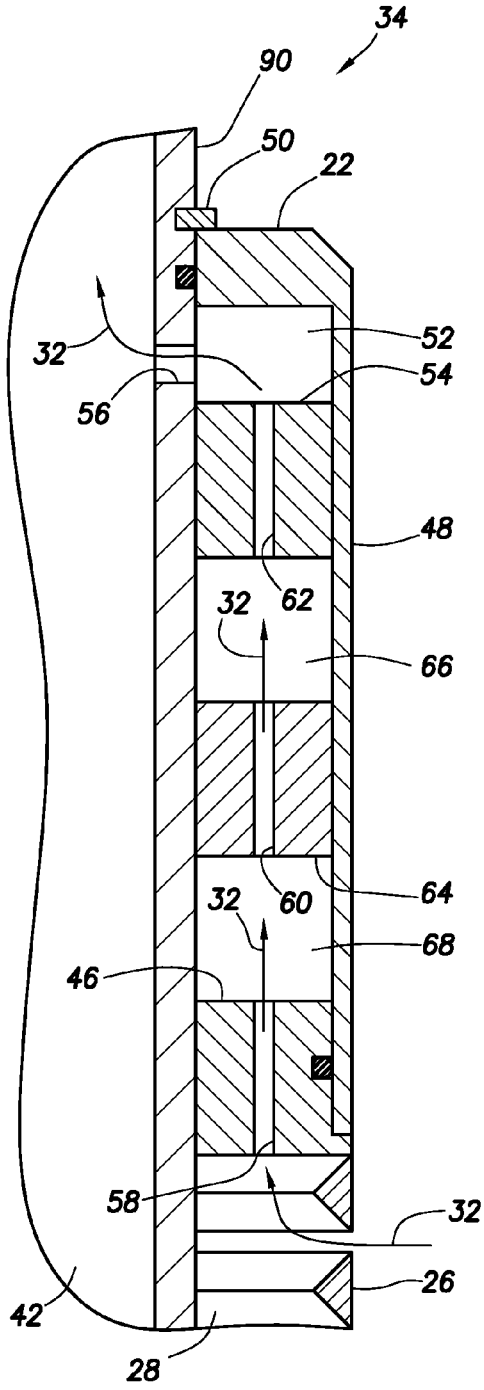
FIG. 5 is a cross-sectional view of a second alternate construction of the inflow control device.

Referring additionally now to FIG. 5, another alternate construction of the inflow control device 34 is representatively illustrated. The inflow control device 34 as depicted in FIG. 5 may be used in the well screen 16, or it may be used in other well screens in keeping with the principles of the invention.

Instead of the tubular flow restrictors 24, 30 of FIGS. 3 & 4, the inflow control device 34 of FIG. 5 utilizes a series of flow restrictors 58, 60, 62 in bulkheads 46, 54, 64 separating the annular space 28 and chambers 52, 66, 68. The flow restrictors 58, 60, 62 are in the form of nozzles or orifices in the bulkheads 46, 54, 64. Although only one flow restrictor 58, 60, 62 is visible in each of the respective bulkheads 46, 54, 64, any number of orifices may be used in any of the bulkheads as appropriate to produce corresponding desired pressure drops.

The inner diameter and other characteristics of the flow restrictors 58, 60, 62 may also be changed as desired to vary the restriction to flow through the orifices. The flow restrictors 58, 60, 62 are depicted in FIG. 5 as being integrally formed in the respective bulkheads 46, 54, 64, but it will be appreciated that the orifices could instead be formed on separate members, such as threaded members which are screwed into and sealed to the bulkheads 46, 54, 64.

If the flow restrictors 58, 60, 62 are formed on separate members, then they may be provided with different characteristics (such as different inner diameters, etc.) to thereby allow a variety of selectable pressure drops between the annular space 28 and the chambers 52, 66, 68 in succession. In addition, any of the flow restrictors 58, 60, 62 could be left out of its respective bulkhead 46, 54, 64 to provide a relatively large opening in the bulkhead (to produce a reduced pressure drop across the bulkhead), or a plug may be installed in place of any orifice (to produce an increased pressure drop across the bulkhead).

The flow restrictors 58, 60, 62 may be accessed by removing the outer housing 48. Alternatively, openings and plugs (such as the opening 20 and plug 44 described above) may be provided in the end wall 22 to access the flow restrictors 58, 60, 62. In this manner, the flow restrictors 58, 60, 62 may be conveniently installed and otherwise accessed at a jobsite.

The flow restrictors 58, 60, 62 are configured in series, so that the fluid 32 must flow through each of the orifices in succession. This produces a pressure drop across each of the bulkheads 46, 54, 64. Although the flow restrictors 58, 60, 62 are depicted in FIG. 5 as being aligned longitudinally, they could instead be laterally offset from one another if desired to produce additional turbulence in the fluid 32 and corresponding additional pressure drops.

Figure 6:
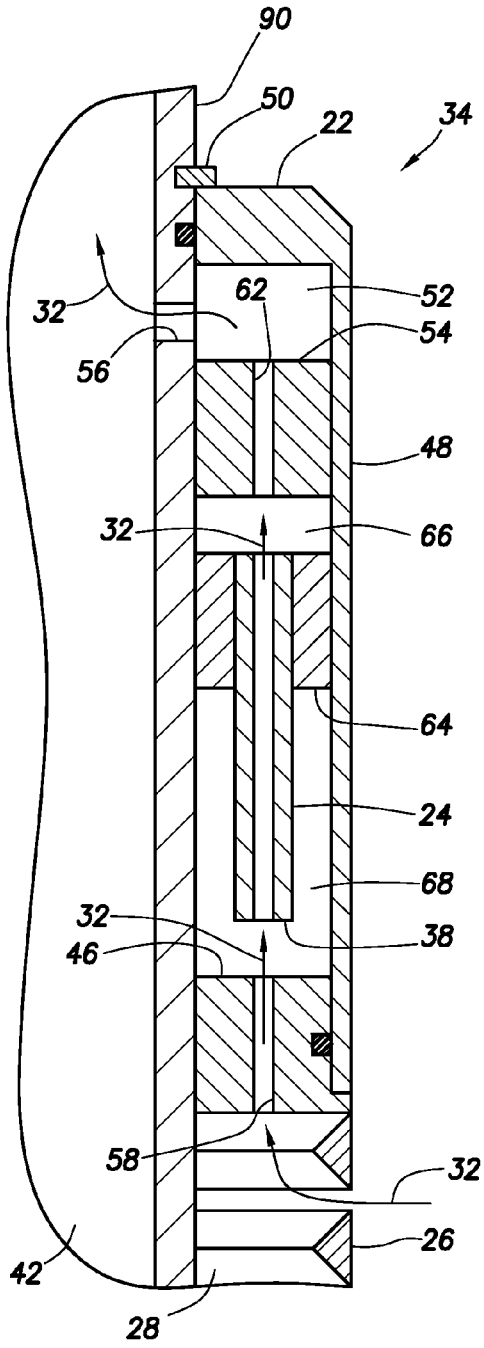
FIG. 6 is a cross-sectional view of a third alternate construction of the inflow control device.

Referring additionally now to FIG. 6, another alternate construction of the inflow control device 34 is representatively illustrated. The inflow control device 34 as depicted in FIG. 6 may be used in the well screen 16, or it may be used in other well screens in keeping with the principles of the invention.

The inflow control device 34 of FIG. 6 differs in at least one substantial respect from the inflow control device of FIG. 5, in that the orifice flow restrictor 60 is replaced by the tubular flow restrictor 24. Thus, the alternate construction of FIG. 6 demonstrates that any combination of flow restrictors may be used in keeping with the principles of the invention.

The flow restrictors 58, 24, 62 are still configured in series, so that the fluid 32 must flow through each of the flow restrictors in succession. Although the flow restrictors 58, 24, 62 are depicted in FIG. 6 as being aligned longitudinally, they could instead be laterally offset from one another if desired to produce additional turbulence in the fluid 32 and corresponding additional pressure drops.

Figure 7:
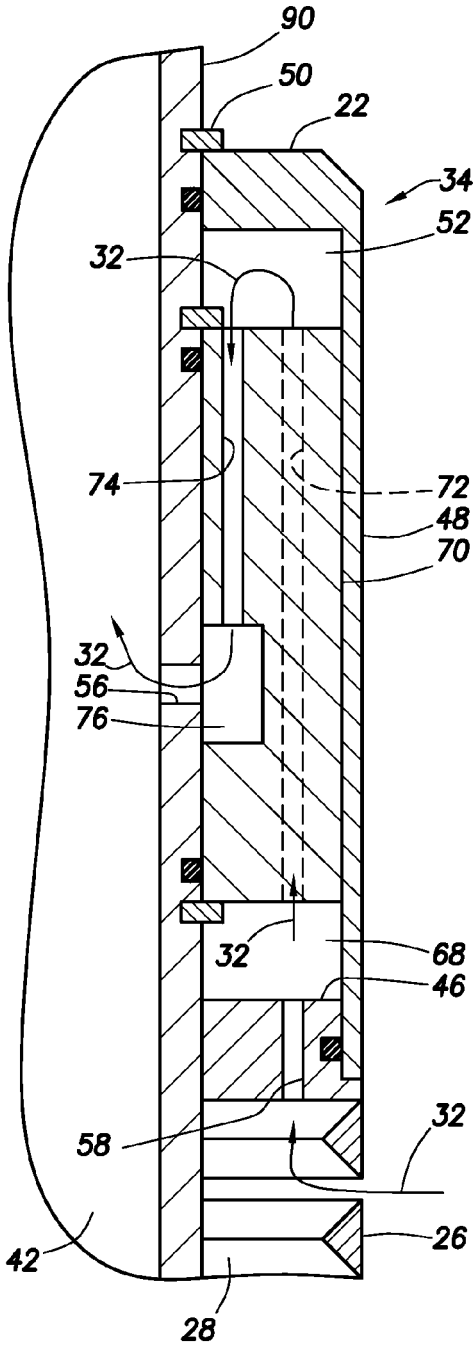
FIG. 7 is a cross-sectional view of a fourth alternate construction of the inflow control device.

Referring additionally now to FIG. 7, another alternate configuration of the inflow control device 34 is representatively illustrated. The inflow control device 34 as depicted in FIG. 7 may be used in the well screen 16, or it may be used in other well screens in keeping with the principles of the invention.

The inflow control device 34 of FIG. 7 differs in substantial part from those described above, in that it includes a manifold 70 having multiple flow restrictors 72, 74 and a chamber 76 formed therein. The manifold 70 is positioned between the chambers 52, 68 in the inflow control device 34.

In one unique feature of the inflow control device 34 of FIG. 7, the fluid 32 flows in one direction through the flow restrictor 72 (from the chamber 68 to the chamber 52), and the fluid flows in an opposite direction through the flow restrictor 74 (from the chamber 52 to the chamber 76). Furthermore, the fluid 32 reverses direction in the chamber 52 (between the flow restrictors 72, 74) and again changes direction in flowing from the chamber 76 and through the passage 42 via the opening 56.

Turbulence and a corresponding pressure drop results from each of these changes in direction of flow of the fluid 32. In addition, pressure drops are caused by the restrictions to flow presented by the flow restrictors 58, 72, 74. The flow restrictors 58, 72, 74 are configured in series, so that the fluid 32 must flow through each of the flow restrictors in succession.

Any number of the flow restrictors 58, 72, 74 may be used. Although the flow restrictors 72, 74 are depicted in FIG. 7 as being integrally formed in the manifold 70, the flow restrictors could instead be formed in separate members installed in the manifold.

If the flow restrictors 72, 74 are formed on separate members, then they may be provided with different characteristics (such as different inner diameters, etc.) to thereby allow a variety of selectable pressure drops between the chambers 52, 68 and the chambers 52, 76 in succession. In addition, any of the flow restrictors 72, 74 could be left out of the manifold 70 to provide a relatively large opening in the manifold (to produce a reduced pressure drop across the manifold), or a plug may be installed in place of any flow restrictor (to produce an increased pressure drop across the manifold).

The manifold 70 and its flow restrictors 72, 74 may be conveniently installed or accessed by removing the outer housing 48. Alternatively, if any of the flow restrictors 58, 72, 74 are formed on separate members, they may be installed or accessed through openings and plugs (such as the opening 20 and plug 44 described above) in the end wall 22.

Figure 8:
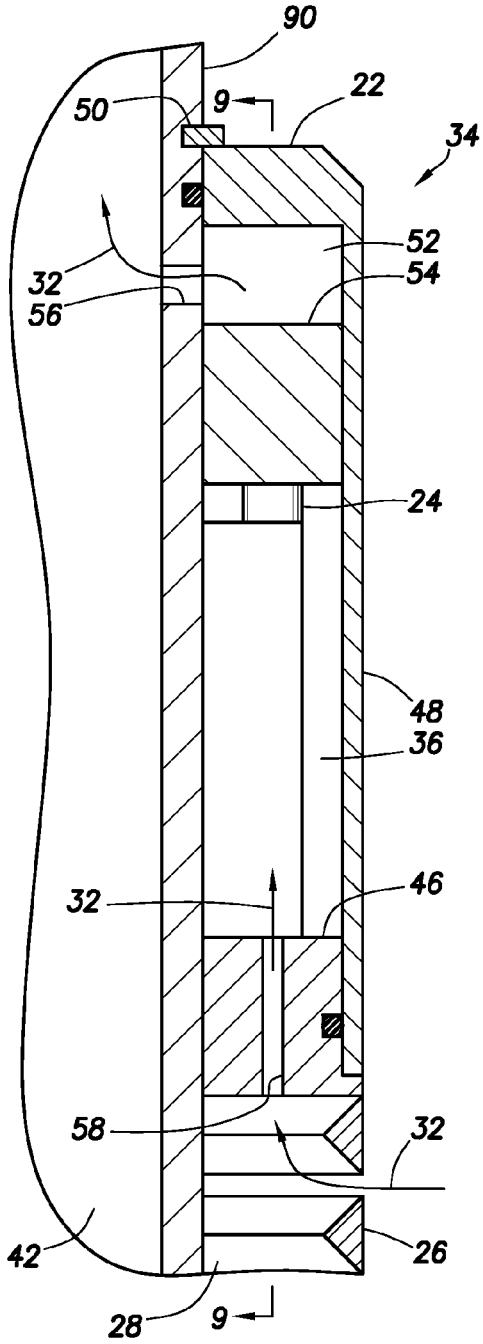
FIG. 8 is a cross-sectional view of a fifth alternate construction of the inflow control device.

Referring additionally now to FIG. 8, another alternate construction of the inflow control device 34 is representatively illustrated. The inflow control device 34 as depicted in FIG. 8 may be used in the well screen 16, or it may be used in other well screens in keeping with the principles of the invention.

The inflow control device 34 of FIG. 8 is similar in many respects to the configuration of FIGS. 3 & 4, but differs in at least one substantial respect in that it includes the flow restrictors 58 and multiple channels 78 in place of the flow restrictors 30. The arrangement of the channels 78 in relation to the flow restrictors 24 may be viewed more clearly in the cross-section of FIG. 9.

Figure 9:
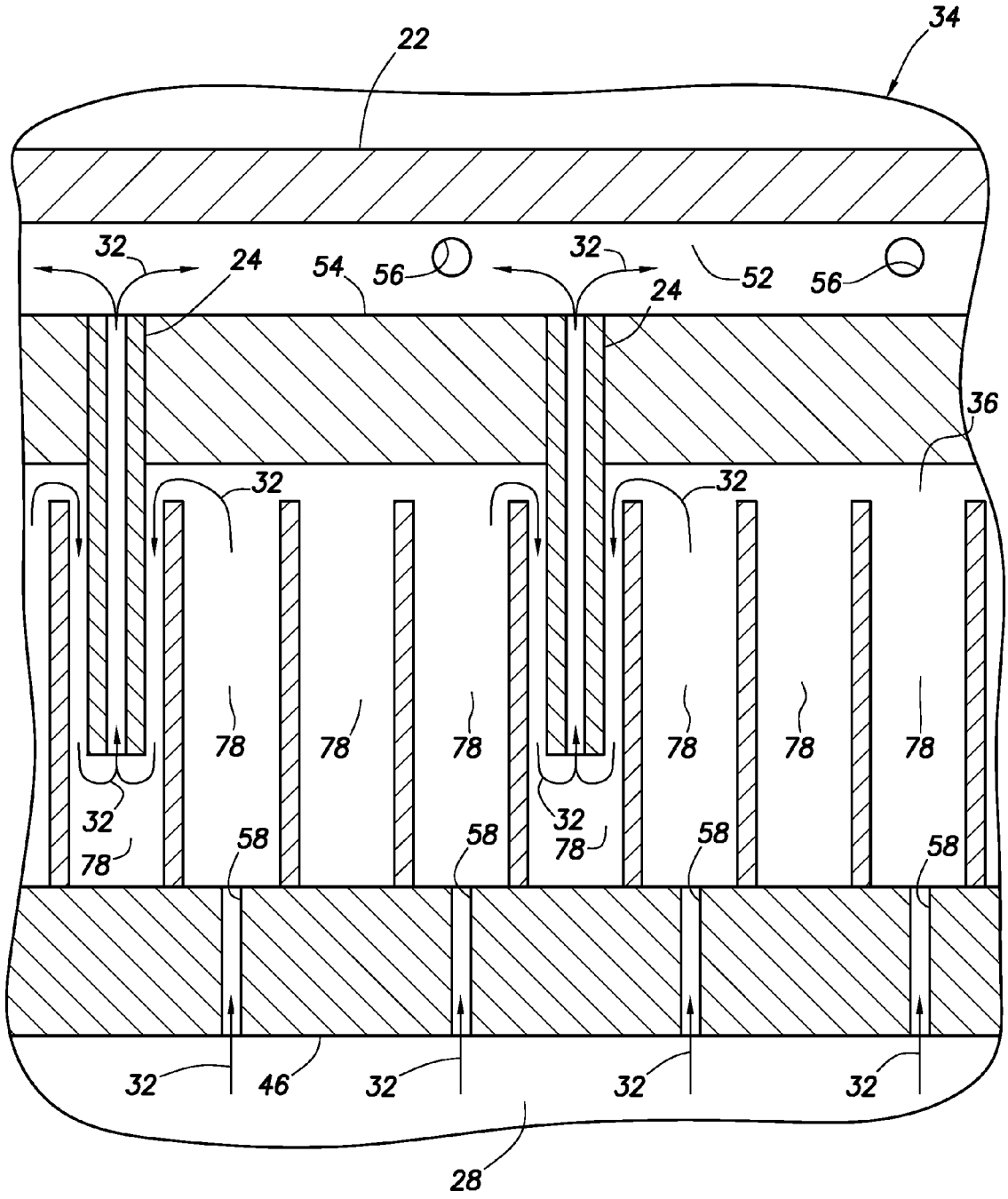
FIG. 9 is a cross-sectional view of the inflow control device, taken along line 9-9 of FIG. 8.

The configuration of FIGS. 8 & 9 provides many of the same benefits as the configuration of FIGS. 3 & 4. The channels 78 create turbulence in the fluid 32 in the chamber 36 and thereby provide a corresponding pressure drop between the flow restrictors 58 and the flow restrictors 24.

Figure 10:
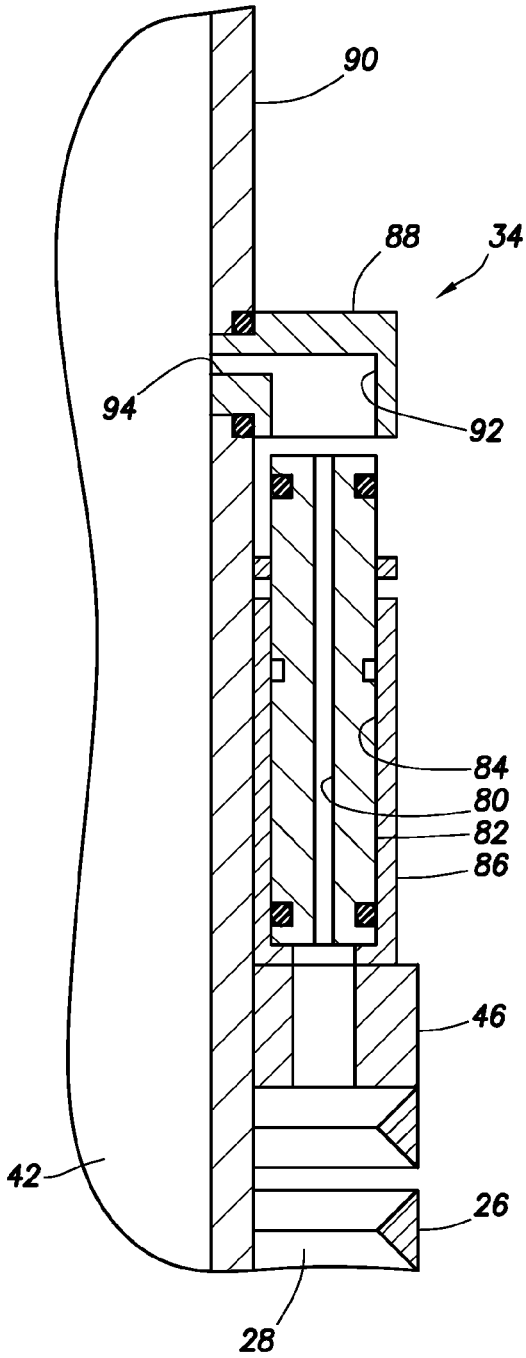
FIG. 10 is a cross-sectional view of a sixth alternate construction of the inflow control device, with the inflow control device being accessed.

Referring additionally now to FIG. 10, another alternate construction of the inflow control device 34 is representatively illustrated. The inflow control device 34 of FIG. 10 may be used in the well screen 16, or it may be used in other screens in keeping with the principles of the invention.

The configuration of the inflow control device 34 as depicted in FIG. 10 differs from the other configurations described above in at least one substantial respect, in that it includes a flow restrictor 80 which is externally positioned in the device. That is, the flow restrictor 80 is not contained within an outer housing or chamber of the inflow control device 34.

Instead, the flow restrictor 80 is formed in a tubular member 82 which is sealingly and reciprocably received in a bore 84 formed in a housing 86. The housing 86 is illustrated in FIG. 10 as being attached to the bulkhead 46 (for example, by welding, etc.), but it will be appreciated that the housing 86 and bulkhead 46 could be integrally formed, and that other arrangements of these elements could be constructed, in keeping with the principles of the invention.

As depicted in FIG. 10, the member 82 has been inserted into the housing 86 sufficiently far so that a receiving device 88 can be installed. The receiving device 88 may be installed in the base pipe 90 of the well screen 16 using threads, seals or any other means of securing and sealing the receiving device to the base pipe.

The receiving device 88 has a bore 92 and a passage 94 formed therein. The bore 92 is for sealingly receiving the tubular member 82 therein, and the passage 94 provides fluid communication between the bore and the flow passage 42.

Thus, at a jobsite, when the well conditions and desired production characteristics are known, the appropriate tubular member 82 with an appropriate flow restrictor 80 therein may be inserted into the housing 86, and then the device 88 may be installed in the base pipe 90. Any number of the tubular member 82 may be used, and the flow restrictor 80 may be varied (for example, by changing an inner diameter or other characteristic of the flow restrictor) to provide a variety of restrictions to flow and pressure drops. The flow restrictor 80 may be formed in a separate member which is then installed (for example, by threading) in the tubular member 82.

Figure 11:
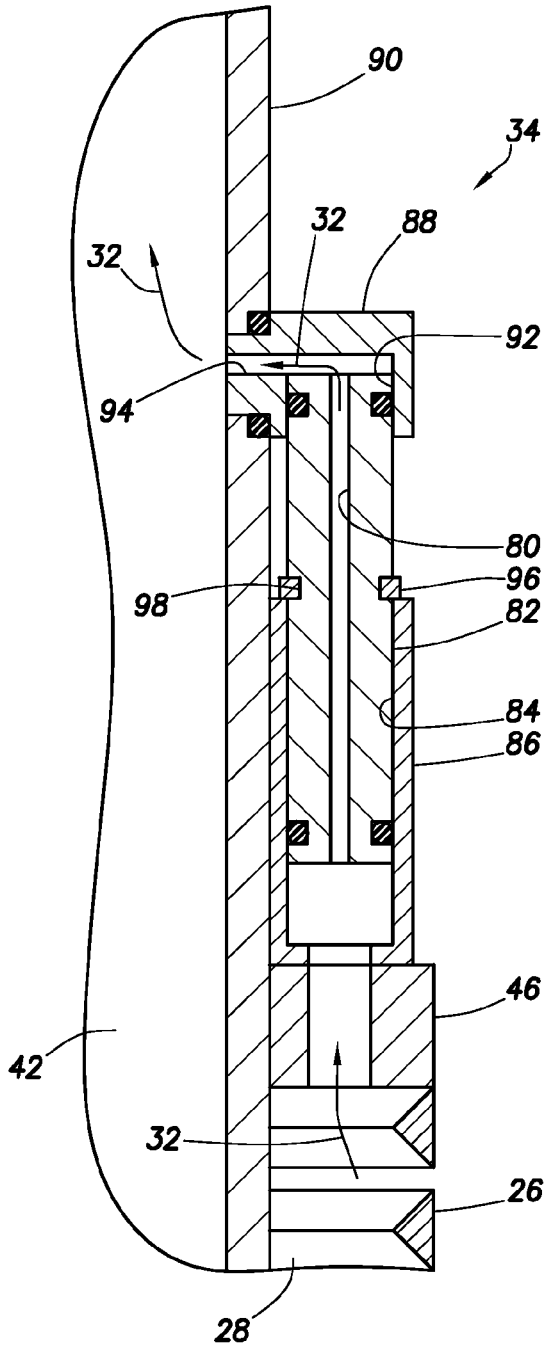
FIG. 11 is a cross-sectional view of the sixth alternate construction of the inflow control device, with the inflow control device being fully installed.

In FIG. 11, the tubular member 82 has been displaced upward, so that it is now sealingly received in the bore 92 of the receiving device 88. A snap ring 96 is then received in a recess 98 formed on the tubular member 82 to maintain the member 82 in this position.

To remove the tubular member 82, the snap ring 96 may be withdrawn from the recess 98, and then the tubular member may be displaced downward in the bore 84 of the housing 86. The receiving device 88 may then be detached from the base pipe 90 and the tubular member 82 may be withdrawn from the housing 86.

In use, the fluid 32 flows through the flow restrictor 80 in the tubular member 82, thereby producing a pressure drop between the annular space 28 and the flow passage 42. If multiple flow restrictors 80 are provided for in the inflow control device 34, then one or more of these may be replaced by a plug (e.g., by providing a tubular member 82 without the flow restrictor 80 formed therein) if desired to provide increased restriction to flow and a corresponding increased pressure drop between the annular space 28 and the flow passage 42.

Figure 12:
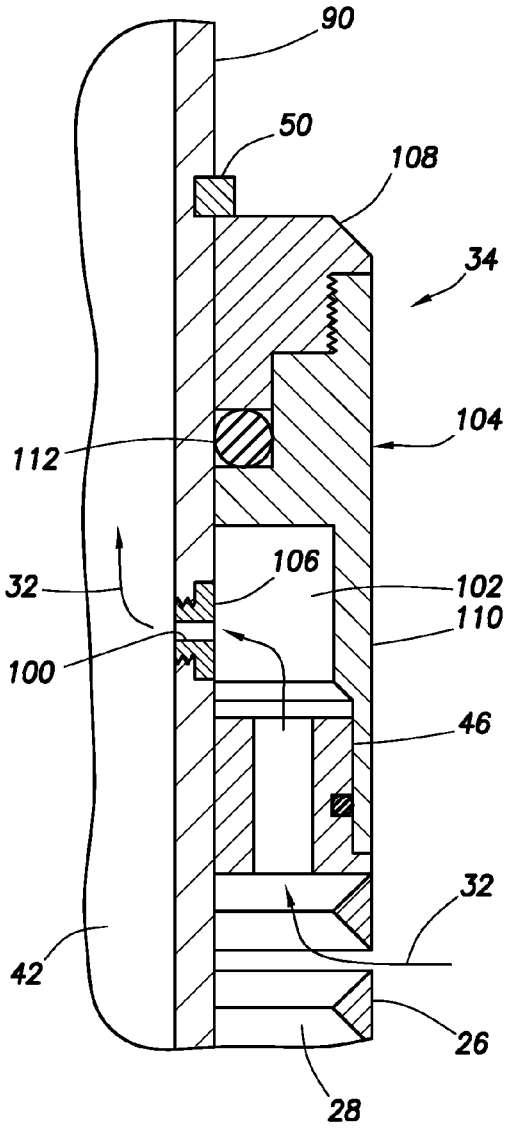
FIG. 12 is a cross-sectional view of a seventh alternate construction of the inflow control device.

Referring additionally now to FIG. 12, another alternate construction of the inflow control device 34 is representatively illustrated. The inflow control device 34 of FIG. 12 may be used in the well screen 16, or it may be used in other well screens in keeping with the principles of the invention.

The inflow control device 34 differs from the other inflow control devices described above in at least one substantial respect, in that it includes a flow restrictor 100 which is installed in the base pipe 90. The flow restrictor 100 provides fluid communication between the flow passage 42 and a chamber 102 within a housing assembly 104 of the inflow control device 34.

Any number of the flow restrictors 100 may be provided. Each flow restrictor 100 may be formed in a separate member 106 installed in the base pipe 90 (for example, using threads and seals, etc.).

If multiple flow restrictors 100 are provided for in the inflow control device 34, then any of the members 106 may be replaced by a plug to increase the pressure drop between the chamber 102 and the flow passage 42. Alternatively, one or more of the members 106 may be left out to thereby provide a relatively large opening between the chamber 102 and the flow passage 42, and to thereby reduce the pressure drop.

The member 106 may be conveniently accessed by removing the housing assembly 104. The housing assembly 104 may include multiple housing members 108, 110 with a compression seal 112 between the housing members. When the housing assembly 104 is installed after accessing or installing the flow restrictor 100, the housing members 108, 110 are drawn together (for example, using threads, etc.) to thereby compress the seal 112 between the housing members and seal between the housing assembly and the base pipe 90.

Figure 13:
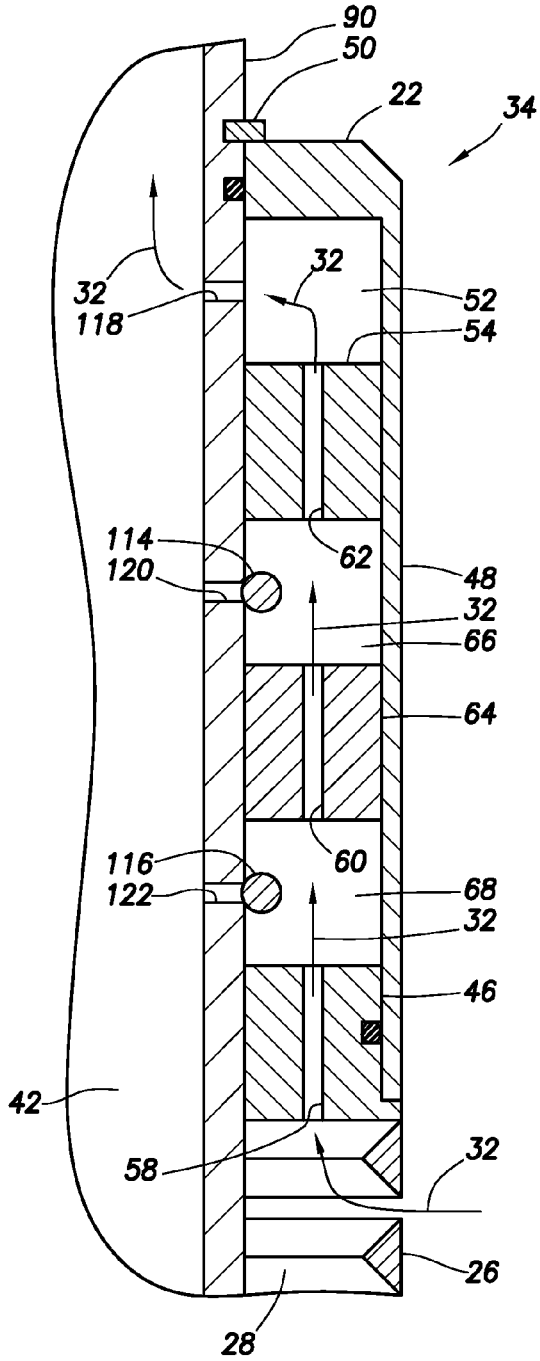
FIG. 13 is a cross-sectional view of an eighth alternate construction of the inflow control device.

Referring additionally now to FIG. 13, another alternate construction of the inflow control device 34 is representatively illustrated. The inflow control device 34 of FIG. 13 may be used in the well screen 16, or it may be used in other screens in keeping with the principles of the invention.

The inflow control device 34 as depicted in FIG. 13 is similar in many respects to the inflow control device of FIG. 5. However, one substantial difference between these inflow control devices 34 is that the device of FIG. 13 includes flow blocking members 114, 116 in the form of balls. Of course, other types of flow blocking members may be used, if desired.

An example of flow blocking members which may be used for the members 114, 116 is described in U.S. Published Application No. 2004/0144544, the entire disclosure of which is incorporated herein by this reference.

Another substantial difference is that the inflow control device 34 of FIG. 13 includes flow restrictors 118, 120, 122 which provide fluid communication between the flow passage 42 and the respective chambers 52, 66, 68. Any number of the flow restrictors 118, 120, 122 may be provided, and the flow restrictors may be formed directly in the base pipe 90, or they may be formed in separate members (such as the member 106 described above), and they may be conveniently installed or accessed by removal of the outer housing 48.

The members 114, 116 are preferably neutrally buoyant in water and, thus, are more dense than hydrocarbon fluid. Alternatively, the members 114, 116 may have a density which is between that of water and hydrocarbon fluid, so that they become buoyant when the fluid 32 contains a certain selected proportion of water.

Note that it is not necessary for the members 114, 116 to have the same buoyancy. For example, the member 114 may be designed to be buoyant in the fluid 32 when it has a certain proportion of water, and the member 116 may be designed to be buoyant in the fluid having another proportion of water.

In this manner, flow through the inflow control device 34 may be increasingly restricted as the proportion of water in the fluid 32 increases. This will operate to reduce the proportion of water produced in the well system 10.

If multiple flow blocking members 114 are provided in the chamber 66, it is not necessary for all of the members to have the same density. Similarly, if multiple flow blocking members 116 are provided in the chamber 68 it is not necessary for all of the members to have the same buoyancy. This is another manner in which increased restriction to flow may be provided as the fluid 32 contains an increased proportion of water.

Various relationships between the number of flow blocking members 114, 116 and respective flow restrictors 60, 62, 120, 122 are contemplated. For example, the number of members 116 in the chamber 68 may be less than the number of flow restrictors 60, 122, so that no matter the composition of the fluid 32, some flow will still be permitted between the chambers 66, 68, or between the chamber 68 and the flow passage 42. As another example, the number of members 116 may be equal to, or greater than, the number of flow restrictors 60, 122, so that flow from the chamber 68 to the chamber 66 or to the flow passage 42 may be completely prevented.

As depicted in FIG. 13, the member 114 is blocking flow through the flow restrictor 120 and the member 116 is blocking flow through the flow restrictor 122, so that the fluid 32 is forced to flow from the chamber 68, through the flow restrictor 60, then through the chamber 66, then through the flow restrictor 62, then through the chamber 52, and then through the flow restrictor 118 and into the flow passage 42. The member 116 could alternatively (or in addition, if multiple members 116 are provided) block flow through the flow restrictor 60, thereby forcing the fluid 32 to flow from the chamber 68 through the flow restrictor 122 and into the flow passage 42. Similarly, the member 114 could alternatively (or in addition, if multiple members 114 are provided) block flow through the flow restrictor 62, thereby forcing the fluid 32 to flow from the chamber 66 through the flow restrictor 120 and into the flow passage 42.

Note that it is not necessary for the specific combination of flow restrictors 58, 60, 62, 118, 120, 122 illustrated in FIG. 13 to be provided in the inflow control device 34. For example, any of the flow restrictors 118, 120, 122 could be eliminated (e.g., by replacing them with plugs, or simply not providing for them, etc.) and either of the members 114, 116 could be used just for blocking flow through the flow restrictors 60, 62. As another example, the flow restrictor 118 could be replaced by the opening 56 described above, which would provide relatively unrestricted flow of the fluid 32 between the chamber 52 and the flow passage 42.

Note that it is also not necessary of the specific combination of flow blocking members 114, 116 illustrated in FIG. 13 to be provided. For example, either of the members 114, 116 could be eliminated. As another example, one or more additional flow blocking members could be provided in the chamber 52 to selectively block flow through the flow restrictor 118.

Figure 14:
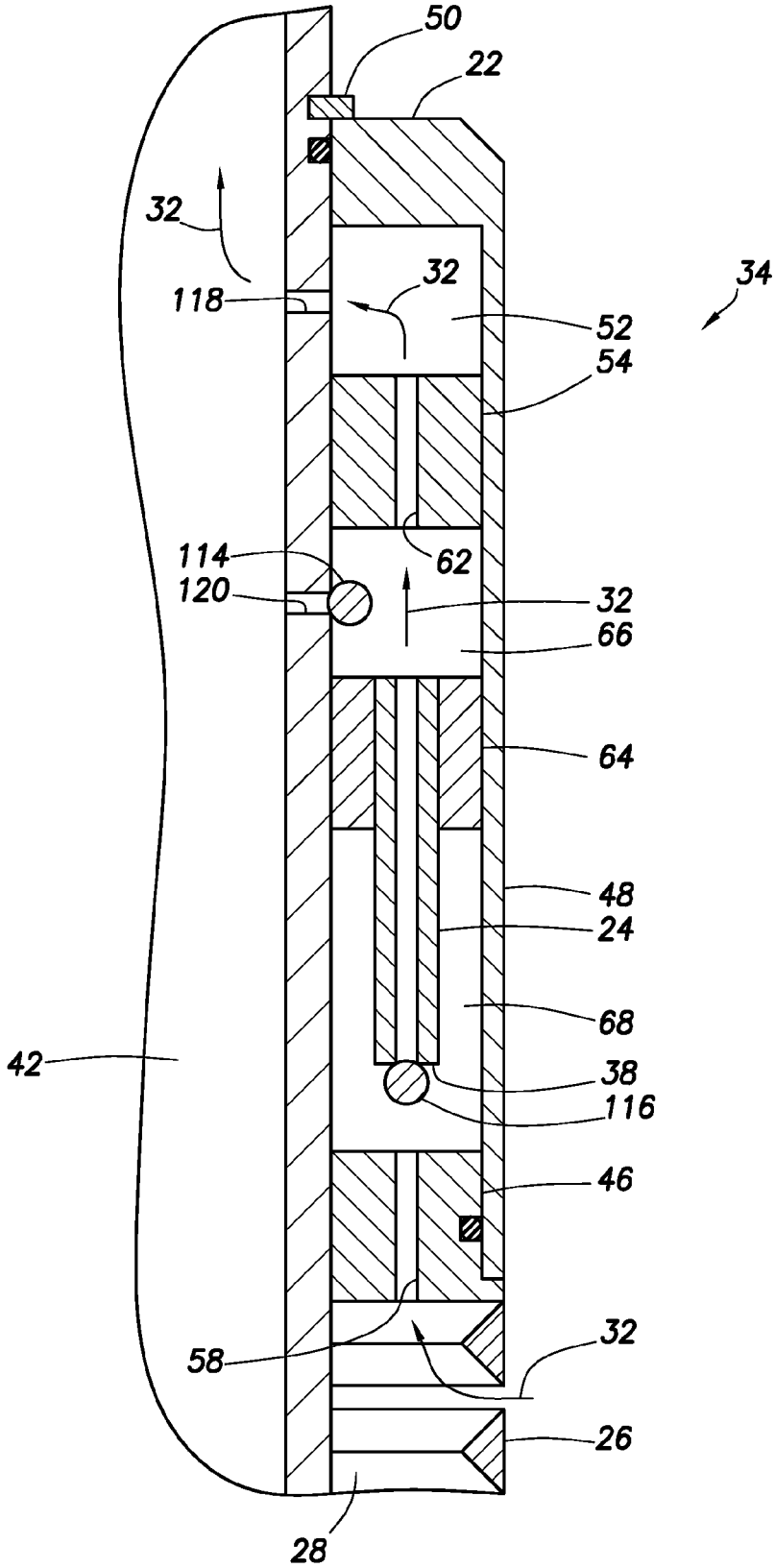
FIG. 14 is a cross-sectional view of a ninth alternate construction of the inflow control device.

Referring additionally now to FIG. 14, another alternate construction of the inflow control device 34 is representatively illustrated. The inflow control device 34 of FIG. 14 may be used in the well screen 16, or it may be used in other screens in keeping with the principles of the invention.

The inflow control device 34 as depicted in FIG. 14 is similar in many respects to the inflow control device of FIG. 6, at least in part because it includes the flow restrictor 24 installed in the bulkhead 64. The inflow control device 34 of FIG. 14 is also similar to the device of FIG. 13, in that it includes the flow blocking members 114, 116 in the respective chambers 66, 68.

However, note that the flow restrictor 122 is not provided in the inflow control device 34 of FIG. 14. Thus, the member 116 only blocks flow through the flow restrictor 24.

As depicted in FIG. 14, the member 116 is blocking flow through the flow restrictor 24. If multiple flow restrictors 24 are installed in the bulkhead 64, and the number of members 116 is less than the number of restrictors, then flow may still be permitted between the chambers 66, 68 via the unblocked restrictors.

Similar to the description above regarding the embodiment of the inflow control device 34 illustrated in FIG. 13, any combination of the flow restrictors 58, 62, 24, 118, 120, 122 and flow blocking members 114, 116 may be used, any number (and any relative numbers) of these elements may be used, the flow blocking members may be used in any (and any combination) of the chambers 52, 66, 68, and any combination of densities of the flow blocking members may be used, without departing from the principles of the invention.

Figure 15:
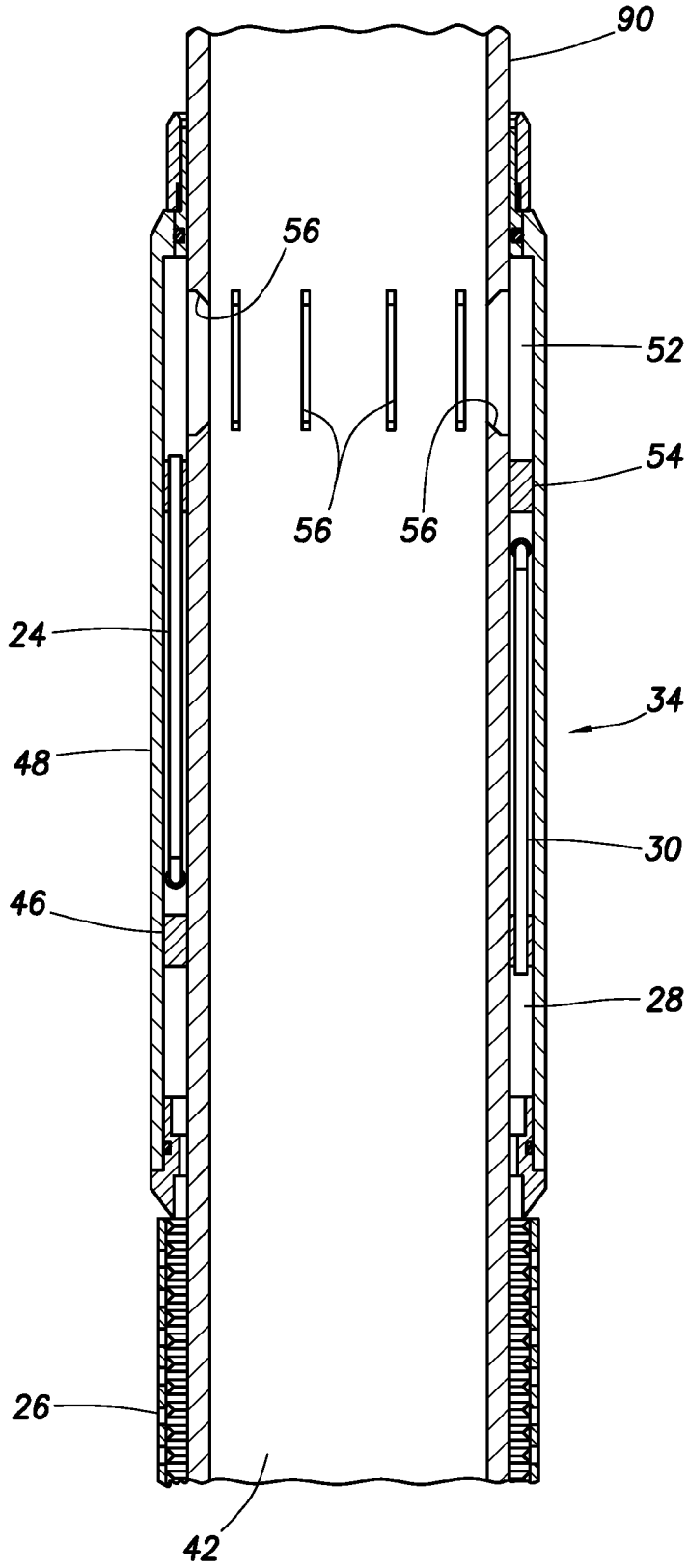
FIG. 15 is a cross-sectional view of a tenth alternate construction of the inflow control device.

Referring additionally now to FIG. 15, an enlarged scale schematic cross-sectional view of another alternate construction of the inflow control device 34 is representatively illustrated. The inflow control device 34 as depicted in FIG. 15 may be used in the well screen 16, or it may be used in other well screens in keeping with the principles of the invention.

The inflow control device 34 includes the multiple flow restrictors 24, 30 configured in series. The flow restrictors 24, 30 are in the shape of elongated tubes, similar in many respects to the inflow control device of FIGS. 3 & 4. However, in the embodiment of FIG. 15, the flow restrictors 24, 30 are curved so that they reverse direction longitudinally.

Figure 16:
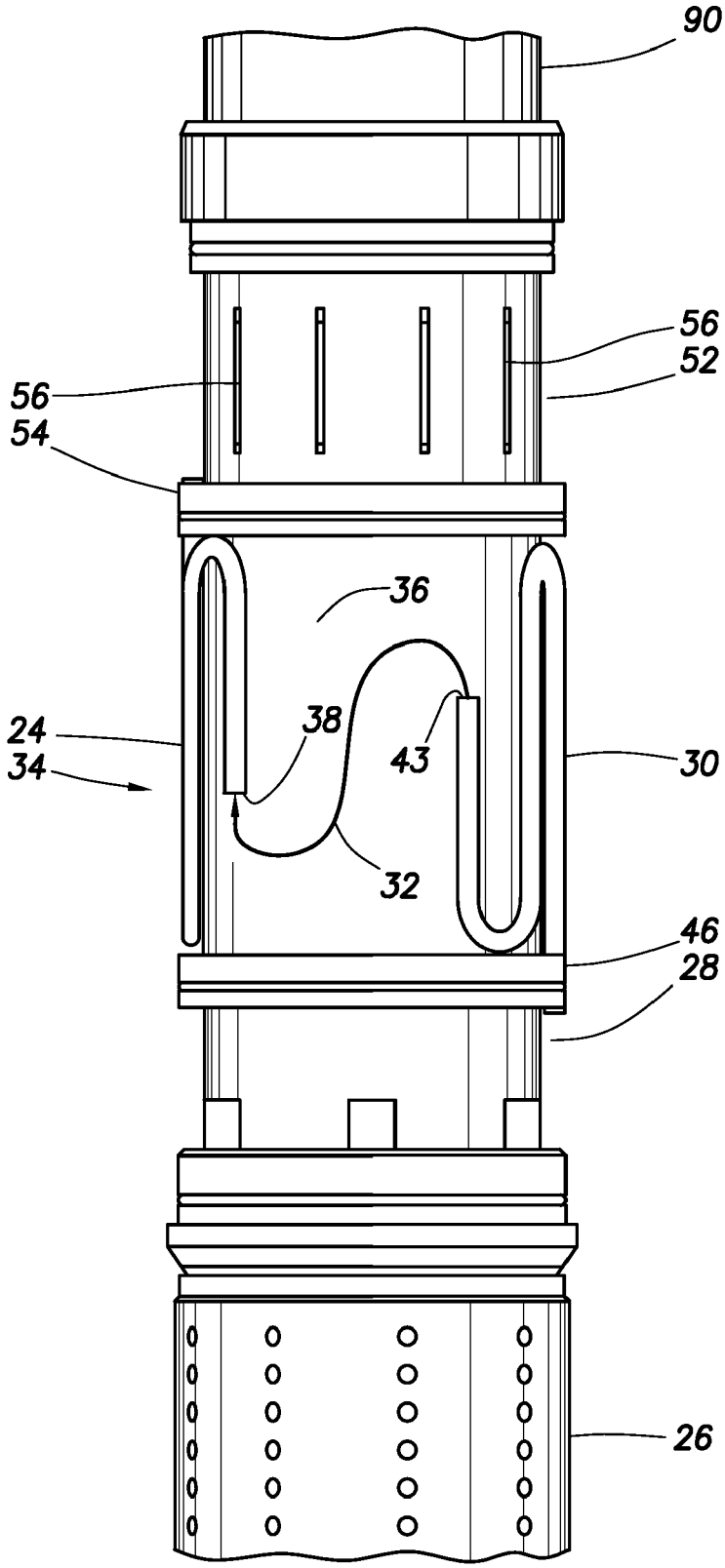
FIG. 16 is an elevational view of the tenth inflow control device construction.

An elevational view of the inflow control device 34 is illustrated in FIG. 16. The elevational view is of the inflow control device 34 of FIG. 15 with the outer housing 48 removed.

In this view, the manner in which the flow restrictors 24, 30 are arranged in the device 34 to cause the fluid 32 to change direction may be clearly seen. The flow restrictors 24, 30 extend into the central chamber 36. The ends 38, 43 of the flow restrictors 24, 30 extend in opposite directions, and the flow restrictors overlap laterally, so that the fluid 32 is forced to reverse direction twice in flowing between the flow restrictors.

From the annular space 28, the fluid 32 flows into the flow restrictors 30 which are installed in the bulkhead 46. Any means of sealing and securing the flow restrictors 30 in the bulkhead 46 may be used. The flow restrictors 30 restrict the flow of the fluid 32, so that a pressure drop results between the annular space 28 and the chamber 36.

The flow restrictors 30 are curved, so that they force the fluid 32 to experience a change in momentum as the fluid flows through the flow restrictors. Specifically, in the embodiment of FIGS. 15 & 16, the flow restrictors 30 force the fluid 32 to change longitudinal direction twice prior to exiting the ends 43 of the flow restrictors. In addition, the flow restrictors 30 force the fluid 32 to flow circumferentially somewhat, thereby requiring a further change in momentum prior to exiting the ends 43 of the flow restrictors.

The pressure drop between the annular space 28 and the chamber 36 may be adjusted by varying the number of the flow restrictors 30, varying the inner diameter, length, curved configuration, manner in which and/or number of times the fluid 32 is forced to change momentum, and other characteristics of the flow restrictors, replacing a certain number of the flow restrictors with plugs, replacing some or all of the flow restrictors with orifices or nozzles, not installing some or all of the flow restrictors (i.e., thereby leaving a relatively large opening in the bulkhead 46), etc. Although two of the flow restrictors 30 are used in the inflow control device 34 as depicted in FIG. 16, any appropriate number may be used in practice.

After the fluid 32 flows out of the ends 43 of the flow restrictors 30, the fluid enters the chamber 36. Since the ends 38, 43 of the flow restrictors 24, 30 overlap, the fluid 32 is forced to reverse direction twice before entering the ends 38 of the flow restrictors 24. These abrupt changes in direction cause turbulence in the flow of the fluid 32 and result in a further pressure drop between the flow restrictors 24, 30. This pressure drop is uniquely achieved without the use of small passages which might become plugged or eroded over time.

As the fluid 32 flows through the flow restrictors 24, a further pressure drop results. The flow restrictors 24 are curved in a manner similar to that described above for the flow restrictors 30, thereby forcing the fluid 32 to change momentum within the flow restrictors. As discussed above, the restriction to flow through the flow restrictors 24 may be altered by varying the length, inner diameter, manner in which and/or number of times the fluid 32 is forced to change momentum, and other characteristics of the flow restrictors.

Due to this flow restriction, a pressure drop is experienced between the chamber 36 and the chamber 52 on the opposite side of the bulkhead 54 in which the flow restrictors 24 are installed. Any method may be used to seal and secure the flow restrictors 24, 30 in the bulkheads 46, 54, such as threads and seals, welding, brazing, etc.

When the fluid 32 enters the chamber, another change in direction is required for the fluid to flow toward the openings 56 which provide fluid communication between the chamber 52 and the flow passage 42. After flowing through the openings 56, a further change in direction is required for the fluid 32 to flow through the passage 42. Thus, another pressure drop is experienced between the chamber 52 and the passage 42.

It will be readily appreciated by those skilled in the art that the configuration of the inflow control device 34 as shown in FIGS. 15 & 16 and described above provides a desirable and adjustable total pressure drop between the annular space 28 and the flow passage 42 without requiring very small passages in orifices (although these could be used if desired), and also provides convenient access to the flow restrictors 24, 30 at a jobsite.

Figure 17:
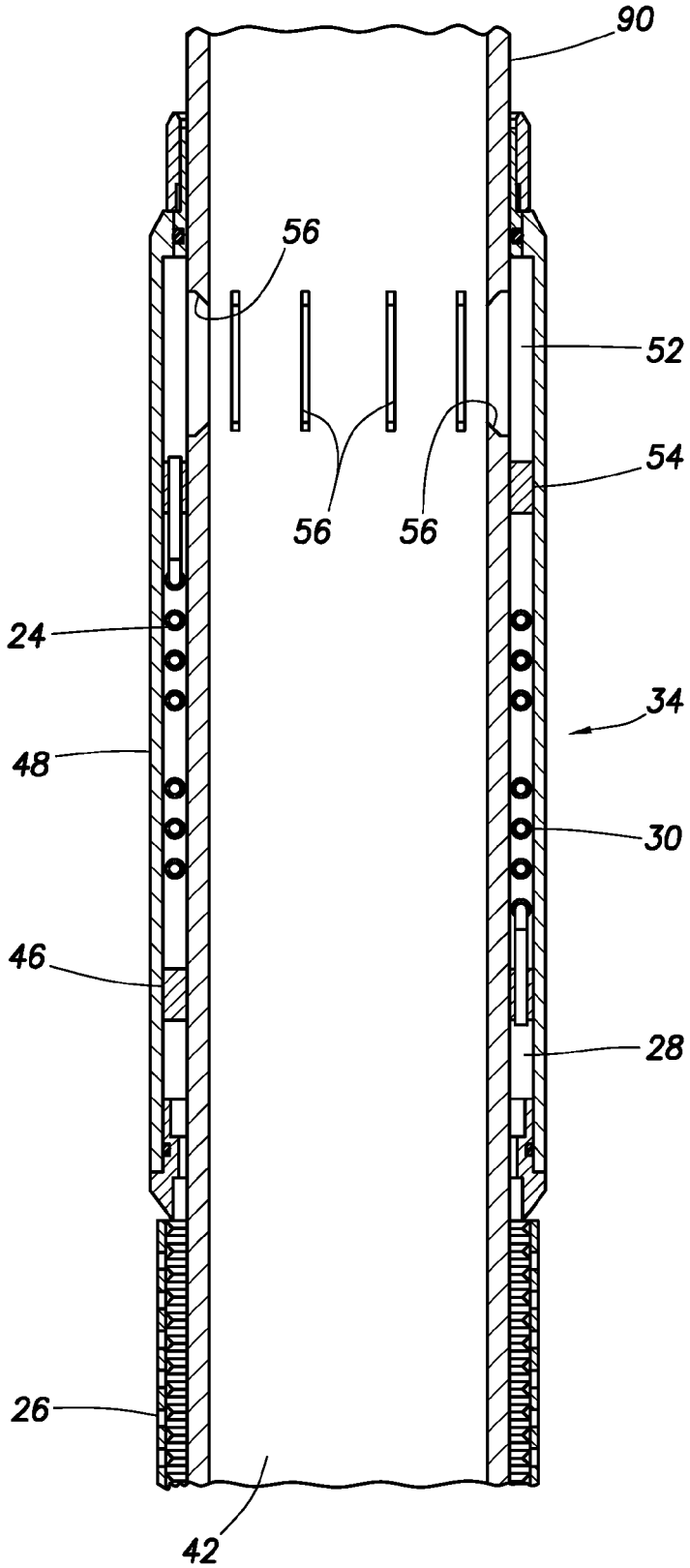
FIG. 17 is a cross-sectional view of an eleventh alternate construction of the inflow control device.

Referring additionally now to FIG. 17, an enlarged scale schematic cross-sectional view of another alternate construction of the inflow control device 34 is representatively illustrated. The inflow control device 34 as depicted in FIG. 17 may be used in the well screen 16, or it may be used in other well screens in keeping with the principles of the invention.

The inflow control device 34 includes the multiple flow restrictors 24, 30 configured in series. The flow restrictors 24, 30 are in the shape of elongated tubes, similar in many respects to the inflow control device of FIGS. 15 & 16. However, in the embodiment of FIG. 17, the flow restrictors 24, 30 are curved helically so that they force the fluid 32 to flow helically through the flow restrictors.

Figure 18:
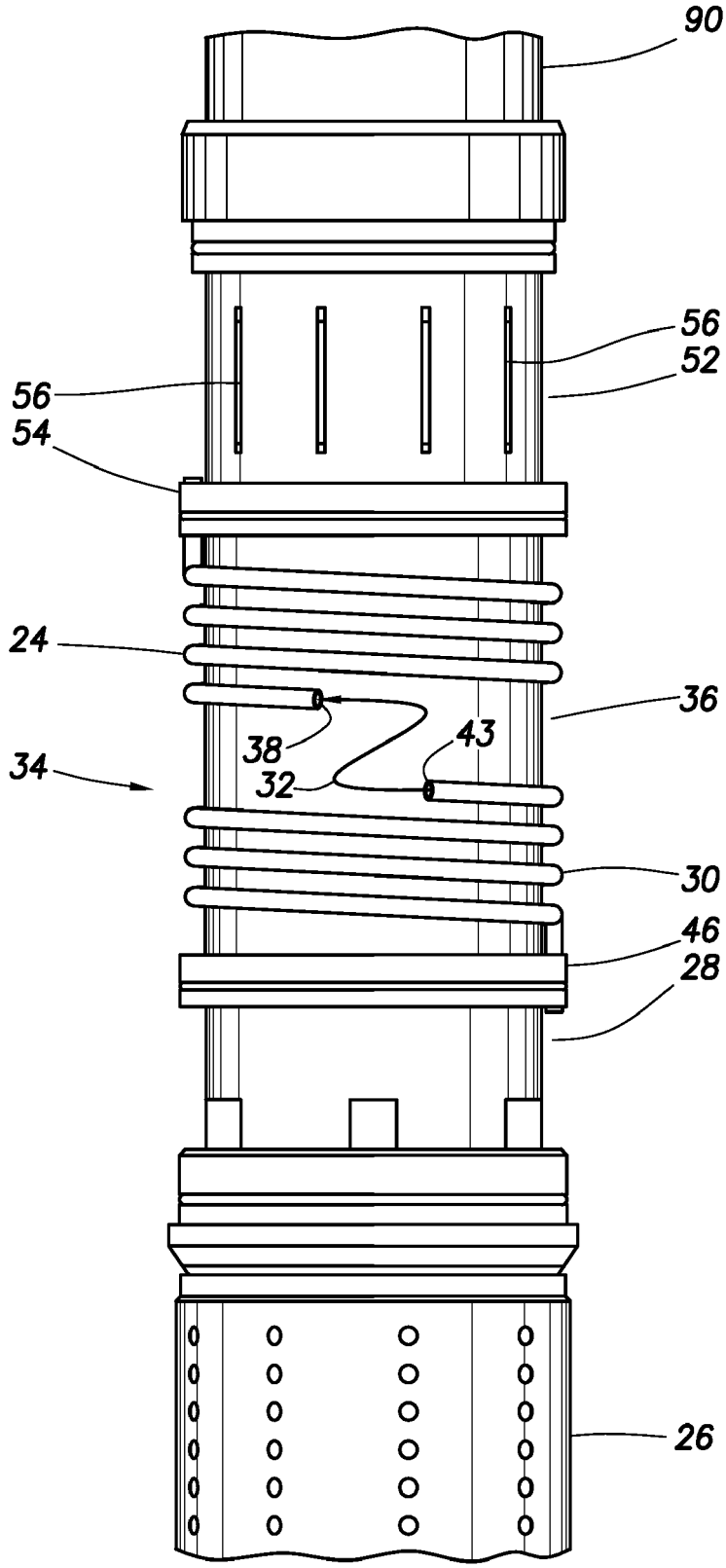
FIG. 18 is an elevational view of the eleventh inflow control device construction.

An elevational view of the inflow control device 34 is illustrated in FIG. 18. The elevational view is of the inflow control device 34 of FIG. 17 with the outer housing 48 removed.

In this view, the manner in which the flow restrictors 24, 30 are arranged in the device 34 to cause the fluid 32 to change direction may be clearly seen. The flow restrictors 24, 30 extend into the central chamber 36. The ends 38, 43 of the flow restrictors 24, 30 extend in opposite directions. The ends 38, 43 of the flow restrictors 24, 30 could overlap longitudinally, if desired, so that the fluid 32 is forced to reverse direction twice in flowing between the flow restrictors.

From the annular space 28, the fluid 32 flows into the flow restrictor 30 which is installed in the bulkhead 46. Any means of sealing and securing the flow restrictor 30 in the bulkhead 46 may be used. The flow restrictor 30 restricts the flow of the fluid 32, so that a pressure drop results between the annular space 28 and the chamber 36.

The flow restrictor 30 is curved, so that it forces the fluid 32 to experience a change in momentum as the fluid flows through the flow restrictors. Specifically, in the embodiment of FIGS. 17 & 18, the flow restrictor 30 forces the fluid 32 to flow circumferentially and longitudinally (i.e., helically), thereby requiring a substantial change in momentum of the fluid prior to exiting the ends 43 of the flow restrictors.

The pressure drop between the annular space 28 and the chamber 36 may be adjusted by varying the number of the flow restrictors 30, varying the inner diameter, length, curved configuration, manner in which and/or number of times the fluid 32 is forced to change momentum, and other characteristics of the flow restrictor, replacing a certain number of the flow restrictors with plugs, replacing the flow restrictor with an orifice or nozzle, not installing the flow restrictor (i.e., thereby leaving a relatively large opening in the bulkhead 46), etc. Although one flow restrictor 30 is used in the inflow control device 34 as depicted in FIG. 16, any appropriate number may be used in practice.

After the fluid 32 flows out of the end 43 of the flow restrictor 30, the fluid enters the chamber 36. If the ends 38, 43 of the flow restrictors 24, 30 overlap, the fluid 32 is forced to reverse direction twice before entering the end 38 of the flow restrictor 24. The abrupt change in direction causes turbulence in the flow of the fluid 32 and results in a further pressure drop between the flow restrictors 24, 30. This pressure drop is uniquely achieved without the use of small passages which might become plugged or eroded over time.

As the fluid 32 flows through the flow restrictor 24, a further pressure drop results. The flow restrictor 24 is helically formed in a manner similar to that described above for the flow restrictor 30, thereby forcing the fluid 32 to change momentum within the flow restrictor 24. As discussed above, the restriction to flow through the flow restrictor 24 may be altered by varying the length, inner diameter, manner in which and/or number of times the fluid 32 is forced to change momentum, and other characteristics of the flow restrictor.

Due to this flow restriction, a pressure drop is experienced between the chamber 36 and the chamber 52 on the opposite side of the bulkhead 54 in which the flow restrictor 24 is installed. Any method may be used to seal and secure the flow restrictors 24, 30 in the bulkheads 46, 54, such as threads and seals, welding, brazing, etc.

When the fluid 32 enters the chamber, another change in direction is required for the fluid to flow toward the openings 56 which provide fluid communication between the chamber 52 and the flow passage 42. After flowing through the openings 56, a further change in direction is required for the fluid 32 to flow through the passage 42. Thus, another pressure drop is experienced between the chamber 52 and the passage 42.

It will be readily appreciated by those skilled in the art that the configuration of the inflow control device 34 as shown in FIGS. 17 & 18 and described above provides a desirable and adjustable total pressure drop between the annular space 28 and the flow passage 42 without requiring very small passages in orifices (although these could be used if desired), and also provides convenient access to the flow restrictors 24, 30 at a jobsite.

The various embodiments of the inflow control device 34 depicted in FIGS. 2-18 and described above have demonstrated how the benefits of the present invention may be achieved in the well screen 16. It should be clearly understood, however, that the invention is not limited to only these examples. For example, any of the flow restrictors, chambers, flow blocking members, openings, plugs, housings, manifolds, and other elements described above may be used in any of the embodiments, and any number and combination of these may be used, so that a vast number of combinations of elements are possible while still incorporating principles of the invention.

In addition, other elements (such as other types of flow restrictors, filter portions, etc.) may be substituted for those described above in keeping with the principles of the invention. For example, any of the flow restrictors 24, 30, 40, 58, 60, 62, 72, 74, 78, 80, 100, 118, 120, 122 described above could be replaced with, or could incorporate, a helical flowpath or other type of tortuous flowpath, such as those described in U.S. Pat. No. 6,112,815, the entire disclosure of which is incorporated herein by this reference.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well screen, comprising:

a filter portion; and multiple flow restrictors configured so that fluid which flows through the filter portion also flows through the flow restrictors, and each flow restrictor including at least one tube which forces the fluid to change momentum within the tube, wherein each of the flow restrictors opens into a common chamber, and wherein the fluid changes direction in the chamber to flow from a first one of the flow restrictors to a second one of the flow restrictors, the first flow restrictor being upstream and the second flow restrictor being downstream with respect to a direction of flow through the chamber.

2. The well screen of claim 1, wherein each tube is curved so that the tube alternates direction between its ends.

3. The well screen of claim 2, wherein the direction is a longitudinal direction.

4. The well screen of claim 1, wherein each tube extends circumferentially about a base pipe of the well screen.

5. The well screen of claim 1, wherein each tube extends both longitudinally and circumferentially about a base pipe of the well screen.

6. The well screen of claim 1, wherein each tube forces the fluid to flow circumferentially within the tube relative to a base pipe of the well screen.

7. A well screen, comprising:

a filter portion; and multiple flow restrictors configured so that fluid which flows through the filter portion also flows through the flow restrictors, and each flow restrictor including at least one tube which forces the fluid to change momentum within the tube, wherein each of the flow restrictors opens into a common chamber, and wherein the fluid changes direction in the chamber to flow from one of the flow restrictors to another of the flow restrictors, and wherein each tube is helically formed.

8. An inflow control device for restricting flow into a passage of a tubular string in a wellbore, the inflow control device comprising:

multiple flow restrictors configured so that fluid flows between the passage and the flow restrictors, and each flow restrictor including at least one tube which forces the fluid to change momentum within the tube, wherein each of the flow restrictors opens into a common chamber, and wherein the fluid changes direction in the chamber to flow from a first one of the flow restrictors to a second one of the flow restrictors, the first flow restrictor being upstream and the second flow restrictor being downstream with respect to a direction of flow through the chamber.

9. The device of claim 8, wherein each tube is curved so that the tube alternates direction between its ends.

10. The device of claim 9, wherein the direction is a longitudinal direction.

11. The device of claim 8, wherein each tube extends circumferentially about a base pipe of a well screen.

12. The device of claim 8, wherein each tube extends both longitudinally and circumferentially about a base pipe of a well screen.

13. The device of claim 8, wherein each tube forces the fluid to flow circumferentially within the tube relative to a base pipe of a well screen.

14. An inflow control device for restricting flow into a passage of a tubular string in a wellbore, the inflow control device comprising:

multiple flow restrictors configured so that fluid flows between the passage and the flow restrictors, and each flow restrictor including at least one tube which forces the fluid to change momentum within the tube, wherein each of the flow restrictors opens into a common chamber, and wherein the fluid changes direction in the chamber to flow from one of the flow restrictors to another of the flow restrictors, and wherein each tube is helically formed.

* * * * *